US008345904B2

(12) United States Patent
Albach et al.

(10) Patent No.: US 8,345,904 B2
(45) Date of Patent: Jan. 1, 2013

(54) HEARING DEVICE WITH A SOUND TRANSDUCER AND METHOD FOR PRODUCING A SOUND TRANSDUCER

(75) Inventors: Thorsten Albach, Erlangen (DE); Reinhard Lerch, Heroldsberg (DE); Alexander Sutor, Erlangen (DE); Tom Weidner, Erlangen (DE); Christian Weistenhöfer, Bubenreuth (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 281 days.

(21) Appl. No.: 12/783,100

(22) Filed: May 19, 2010

(65) Prior Publication Data

US 2010/0296681 A1 Nov. 25, 2010

(30) Foreign Application Priority Data

May 19, 2009 (EP) ..... 09160640

(51) Int. Cl.
*H04R 25/00* (2006.01)

(52) U.S. Cl. ..... 381/322

(58) Field of Classification Search ..... 381/312–331
See application file for complete search history.

(56) References Cited

U.S. PATENT DOCUMENTS 7,142,682 B2 * 11/2006 Mullenborn et al. ..... 381/322
7,254,247 B2 * 8/2007 Kragelund et al. ..... 381/322
7,369,671 B2 * 5/2008 Sacha et al. ..... 381/331
7,447,325 B2 * 11/2008 Bren et al. ..... 381/331
7,929,714 B2 * 4/2011 Bazarjani et al. ..... 381/111
2006/0013420 A1 * 1/2006 Sacha ..... 381/312

FOREIGN PATENT DOCUMENTS

DE 102007030744 A1 1/2009
WO 2009004000 A1 1/2009

OTHER PUBLICATIONS

Fischer et al., "Micromechanical Piezoelectric Actuator for Hearing Aid Application" Acta Acustica United with Hearing Aid Application, vol. 90 (2004) pp. 868-872.
Albach et al., "Measuring Technology for a Magnetostrictive Microactuator" Universitaet Erlangen-Nuernberg, Lehrstuhl fuer Sensorik, 2009, Germany.

* cited by examiner

*Primary Examiner* — Jeffrey Donels
(74) *Attorney, Agent, or Firm* — Laurence A. Greenberg; Werner H. Stemer; Ralph E. Locher

(57) ABSTRACT

In hearing devices, more particularly in hearing aids, it is desirable to be able to design an earpiece for generating sound in the audible range which is as small as possible. Such an earpiece can then be worn comfortably on an ear or in an auditory canal. A sound transducer for the hearing device disclosed here may be formed as a micro-electromechanical system and the transducer enables generation of an acoustic signal with little distortion. Provision is made for a hearing device with a sound transducer, which has a field generation apparatus for generating an electric or magnetic field and an emission apparatus for generating sound. Here, the emission apparatus has a multiplicity of fingers that are penetrated by the field of the field generation apparatus, wherein the shape of the fingers can be changed by means of the field of the field generation apparatus in order to generate the sound.

16 Claims, 5 Drawing Sheets

HEARING DEVICE WITH A SOUND TRANSDUCER AND METHOD FOR PRODUCING A SOUND TRANSDUCER

CROSS-REFERENCE TO RELATED APPLICATION

This application claims the priority, under 35 U.S.C. §119, of European patent application EP 09 160 640, filed May 19, 2009; the prior application is herewith incorporated by reference in its entirety.

BACKGROUND OF THE INVENTION

Field of the Invention

The invention relates to a hearing device with a sound transducer for generating airborne sound. The sound transducer comprises a field generation apparatus for generating an electric or magnetic field and an emission apparatus for generating airborne sound. Here the term hearing device is understood to mean a hearing aid in particular. However, the term also includes other portable acoustic equipment such as headsets, headphones, and the like.

Hearing aids are portable hearing devices used to support the hard of hearing. In order to make concessions for the numerous individual requirements, different types of hearing aids are provided, such as, for example, behind-the-ear (BTE) hearing aids, hearing aids with an external earpiece (receiver in the canal, RIC) and in-the-ear (ITE) hearing aids, for example concha hearing aids or canal hearing aids (ITE, CIC) as well. The hearing aids listed by way of example are worn on the concha or in the auditory canal. Furthermore, bone conduction hearing aids, implantable or vibrotactile hearing aids are also commercially available. In this case, the damaged sense of hearing is stimulated either mechanically or electrically.

In principle, the main components of a hearing aid are an input transducer, an amplifier, and an output transducer. In general, the input transducer is a sound receiver, e.g. a microphone, and/or an electromagnetic receiver, e.g. an induction coil. The output transducer is usually designed as an electroacoustic transducer, e.g. a miniaturized loudspeaker, or as an electromechanical transducer, e.g. a bone conduction earpiece. The amplifier is usually integrated into a signal-processing unit. The basic configuration is illustrated in FIG. 1 using the example of a behind-the-ear hearing aid. One or more microphones 2 for recording the sound from the surroundings are installed in a hearing-aid housing 1 to be worn behind the ear. A signal-processing unit 3, likewise integrated into the hearing-aid housing 1, processes the microphone signals and amplifies them. The output signal of the signal-processing unit 3 is transferred to a loudspeaker or earpiece 4, which emits an acoustic signal. If necessary, the sound is transferred to the eardrum of the equipment wearer using a sound tube that is fixed in the auditory canal with an ear mold. A battery 5 likewise integrated into the hearing-aid housing 1 supplies the hearing aid and in particular the signal-processing unit 3 with energy.

An earpiece is an electroacoustic sound transducer. It allows the conversion of an electric audio signal into acoustic airborne sound. In the context of hearing devices, the goal is to develop earpieces that are as small as possible, which can then be worn more comfortably on the ear or even within the auditory canal. It is therefore desirable to provide a loudspeaker that is no larger than a few millimeters and the volume of which is merely a few cubic millimeters. Commonly assigned international PCT Publication No. WO 2009/004000 A1 and its counterpart German published patent application DE 10 2007 030 744 A1 disclose such a micro-loudspeaker, provided in the form of a microchip.

Such a microchip is an integrated circuit, in which electronic components are formed on a carrier substrate. Here, in this microchip, the components are made of layers of different materials that are applied onto the carrier substrate in succession during the production of the microchip and that are subsequently removed again in part, for example by means of an etching or pickling method, in order to make the desired structures of the components in this fashion. In addition to electronic components, it is also possible to form electromechanical actuators on a carrier substrate in the same fashion. An appropriate microchip is then referred to as a micro-electromechanical system (MEMS).

The micro-loudspeaker described in the document has a plate, which is hung onto a frame at two locations. Furthermore, the plate is coated with a magnetostrictive material. The plate and the magnetostrictive layer together make an emission apparatus for generating airborne sound. A magnetic field can be generated by means of a field generation apparatus consisting of a coil and a coil core. When the field penetrates the magnetostrictive layer, the latter deforms in accordance with the magnetostrictive effect. Since the layer adheres to the plate, mechanical tensions are generated in the plate in the process and this bends the plate. By changing the magnetic field as a function of an electric audio signal, the plate is correspondingly made to oscillate. It then acts like a membrane and emits airborne sound into the surroundings.

When developing micro-loudspeakers, care has to be taken that the natural-mode property of an emission apparatus of a sound transducer does not distort the acoustic signal in an undesired fashion.

SUMMARY OF THE INVENTION

It is accordingly an object of the invention to provide a hearing device with a sound transducer and a method of producing such a sound transducer, which overcome the above-mentioned disadvantages of the heretofore-known devices and methods of this general type and which provide for a hearing device a sound transducer that can be designed as a miniature loudspeaker and by means of which an acoustic signal with low distortion can be generated.

With the foregoing and other objects in view there is provided, in accordance with the invention, a hearing device with a sound transducer, which comprises:

a field generation apparatus for generating an electric or magnetic field; and an emission apparatus for generating sound, the emission apparatus having a multiplicity of fingers disposed to be penetrated by the field of the field generation apparatus, the fingers having a shape to be changed by way of the field of the field generation apparatus in order to generate the sound.

With the above and other objects in view there is also provided, in accordance with the invention, a method for producing a sound transducer with a multiplicity of fingers for generating sound, the method which comprises:

providing a substrate;

arranging a protective layer on a front side of the substrate, wherein a shape of the fingers is determined by a profile of an edge of the protective layer; and applying a medium for dissolving the substrate to the front side and a rear side of the substrate.

Preferably, the providing step comprises providing a carrier substrate with layers arranged thereon for forming the fingers; the carrier substrate consists of silicon with the crystal orientation <100>; and the protective layer is formed such that a longitudinal axis of the respective fingers is arranged at an angle of 45° to the crystal axes of the carrier substrate.

The hearing device according to the invention is provided with a sound transducer with a field generation apparatus and an emission apparatus. The field generation apparatus can generate an electric or magnetic field. The emission apparatus has a plurality of fingers that are penetrated by the field of the field generation apparatus. Here, a finger is intended to mean a structure with a long, flat and narrow shape. Such a finger is a self-supporting structure, which is only held on a narrow side. Pictorially, a finger can be compared to the tooth of a comb.

In the hearing device according to the invention, the shape of each tooth or finger can be changed by the field of the field generation apparatus. Sound can thereby be produced by means of the emission apparatus.

The generation of sound is based on the following principle: The shape of each finger depends on the electric or magnetic field penetrating said respective finger. In the process, depending on the field strength, the fingers bend and so freely movable ends of the fingers are deflected, for example, in the direction of the smallest extent of the fingers. By changing the field of the field generation apparatus, the fingers can be put into a spiral motion and so the freely movable ends oscillate to and fro. This allows the generation of sound waves in a medium surrounding the fingers, which sound waves spread into the surroundings and are thus emitted by the emission apparatus. Hence, the fingers form actuators of the emission apparatus. The fingers preferably generate sound in the air. However, sound can also be generated in water or in a bone.

In the emission apparatus of the hearing device according to the invention, an acoustic property, more particularly the natural-mode property, can be set in a particularly simple and precise fashion by appropriately dimensioning the individual fingers. This results in the advantage of being able to provide the sound transducer as a micro-loudspeaker and, in the process, being able to set the acoustic properties of the emission apparatus in a targeted fashion, as desired.

In the case of the hearing device according to the invention, at least one of the fingers is made of at least two layers arranged in parallel. Here, at least one of these layers can be deformed by the inverse piezoelectric effect or by the magnetostrictive effect. Here, such a deformable layer is referred to as an active layer. In the process, the other layer can be e.g. a passive layer, which does not independently deform significantly when penetrated by an electric or magnetic field. Parallel arrangement and connection of for example a passive layer with the active layer that can be deformed by means of a field allows a field to bend these two layers across the plane of the layers. The functionality of a finger made like this can be compared to a bimetal, with a bimetal of course bending as a function of temperature.

The resulting advantage in the case of the at least two-layer fingers is that there is particularly large bending of the fingers and hence deflection of the freely movable ends of the fingers as well.

According to an advantageous development of the hearing device according to the invention, at least one finger has two layers which can be deformed by the inverse piezoelectric or the magnetostrictive effect. In other words, the finger therefore has at least two active layers. The layers can then be designed such that they can be used to generate a force in opposite directions. One of the two layers can then be used to generate a force by means of which the finger is bent in one direction. The other layer can then be designed to generate a restoring force by means of which the finger is bent in the opposite direction. This advantageously results in the ability to control an oscillatory behavior of the finger in a particularly precise fashion. The layers can also be made such that they can be deformed by different types of fields.

In the case of the deflection apparatus, provision is preferably made for a layer with a hole above which the fingers are arranged. The freely movable ends of the fingers can then oscillate freely in the air. By arranging the fingers above the hole, provision can also advantageously be made for a resonant cavity in the sound transducer.

In an advantageous development of the hearing device according to the invention, the emission apparatus has a membrane covering the fingers. The resulting advantage in this case is that no air can flow between the individual fingers and hence an acoustic short circuit is avoided in the emission apparatus. Here, the membrane is preferably made of polyethylene terephthalate (PET). A membrane made of PET is particularly flexible and so a force additionally required for also deforming the membrane when deforming the fingers is particularly small.

A different, advantageous development of the hearing device according to the invention results if the emission apparatus is provided with two rows of fingers arranged parallel to one another. These two rows can then be arranged opposite one another in a plane and so provision can be made for a sufficiently large space for generating the sound, in which space fingers are deflected in a synchronized fashion as a function of the electric audio signal in order to generate the sound. This allows an advantageous combined operation of the multiplicity of fingers for the combined generation of sound waves.

A further advantage results in this development of the hearing device according to the invention if the fingers in one row are of equal length. Then the fingers also bend to a similar degree when a particular field is generated. Hence the spacings between the freely movable ends of the fingers also only vary slightly. As a result of this, gaps formed between the individual fingers are not significantly widened during the deformation of the fingers. This allows the prevention of an acoustic short circuit as is caused when too much air can flow between the fingers.

In another advantageous development of the hearing device according to the invention, provision is made for fingers of different lengths. This allows the provision of fingers with different natural frequencies, i.e. with different mechanical natural-mode properties. The resultant advantage is that the acoustic properties of the emission apparatus can be set by adjusting the lengths of individual fingers.

It is furthermore advantageous for the fingers to be arranged offset to one another. Then there are particularly short gaps between the fingers. This advantageously increases the acoustic radiation resistance of the emission apparatus and, more particularly, the acoustic radiation resistance of the gaps.

In a further advantageous embodiment of the hearing device according to the invention, two fingers of equal length are in each case arranged opposite to one another. As was already explained in the context of a parallel arrangement of fingers of equal length, this also results in the advantage of there always being a small spacing between the freely movable finger ends for differently strong field strengths and, as a result of this, particularly little air being able to flow past the two finger ends.

In another advantageous development of the hearing device according to the invention, the field generation apparatus has a permanent magnet. This allows a shape of the fingers, i.e. the bending thereof, to be set in the case where there is no acoustic signal by means of which the field is determined. Thus, the permanent magnets can advantageously set an operating point of the emission apparatus.

In a preferred embodiment of the hearing device according to the invention, the sound transducer is designed as a microelectromechanical system. This results in the advantage of being able to design a particularly small sound transducer.

An advantageous development is the result of the field generation apparatus having a flat coil. The field generation apparatus can then advantageously be provided as a microchip.

In a preferred embodiment of the hearing device according to the invention, the field generation apparatus is designed at least in part as a first microchip and the emission apparatus is designed as a second microchip. Here, the sound transducer is formed by connecting the two microchips. This embodiment results in a number of advantages. Firstly, the two microchips can be produced independently of one another, and so a production process can be optimized for the field generation apparatus on the one hand and the emission apparatus on the other hand, particularly in respect of the requirements placed on the respective apparatuses. At the same time, the production processes can also be simplified without adversely affecting the quality of one of the two apparatuses in the process. Additionally, the two microchips can be provided in a particularly flat fashion and with a particularly small number of layers. However, it is also possible for provision to be made for a particularly large resonant cavity in the emission apparatus by arranging the two microchips correspondingly far apart on the emission apparatus. Finally, permanent magnets can be arranged between the two microchips.

A further aspect of the invention relates to a method for producing a sound transducer. Here, the sound transducer has a multiplicity of fingers for generating sound. According to the method, provision is firstly made for a substrate. A protective layer is arranged on a front side of the substrate, wherein a shape of the fingers is determined by a profile of an edge of the protective layer. Then a medium for dissolving the substrate is applied to the front side and a rear side of the substrate.

The method according to the invention results in the advantage of being able to produce an emission apparatus of a sound transducer for the hearing device according to the invention as a microchip.

A carrier substrate with layers arranged thereon for forming the fingers can be provided as a substrate. In the process, the carrier substrate preferably consists of silicon with the crystal orientation <100>. Here, the specification of the crystal orientation corresponds to the notation conventionally used in the context of producing microchips. By way of example, the carrier substrate can be a wafer with the corresponding orientation. The protective layer is then preferably arranged such that a longitudinal axis of the respective fingers is arranged at an angle of 45° to the crystal axes of the carrier substrate. Overall, this results in the advantage that the medium for dissolving can reach below the fingers in a particularly simple fashion and this reliably removes the carrier substrate from directly below the fingers.

The protective layer can be made by a photoresist. Such a photoresist can be illuminated in sections by means of a lithography mask and can subsequently be washed off by means of an appropriate solution such that only the part of the photoresist with the desired figure, acting as a protective layer, remains adhered to the substrate. In order to produce the sound transducer, the front side of the substrate can then in a further step be covered together with the protective layer. Subsequently, a medium to dissolve the substrate is applied to a rear side of the substrate and so a hole in the substrate is created on the rear side. Before a through-hole is made in the substrate by the medium, the cover on the front side is removed and so the protective layer and, in particular, the regions of the substrate not covered by the protective layer as well are uncovered. In a further step, a medium for dissolving the substrate is applied to the front side of the substrate. This step then results in a breakthrough between the front side and the rear side, wherein the shape of the through-hole is determined by the protective layer. In order words, the fingers as free-standing structures in the substrate are made in this step.

The method according to the invention can likewise be developed according to the developments of the hearing device according to the invention. This then also results in the advantages explained in conjunction with the developments of the hearing device according to the invention.

Other features which are considered as characteristic for the invention are set forth in the appended claims.

Although the invention is illustrated and described herein as embodied in a hearing device with a sound transducer and method for producing a sound transducer, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

The features of the individual embodiments of the hearing device according to the invention explained in conjunction with the examples can also be provided in any of a variety of different combinations than the one shown in the respective examples, or even on their own in a further embodiment of the invention.

Figure 1:
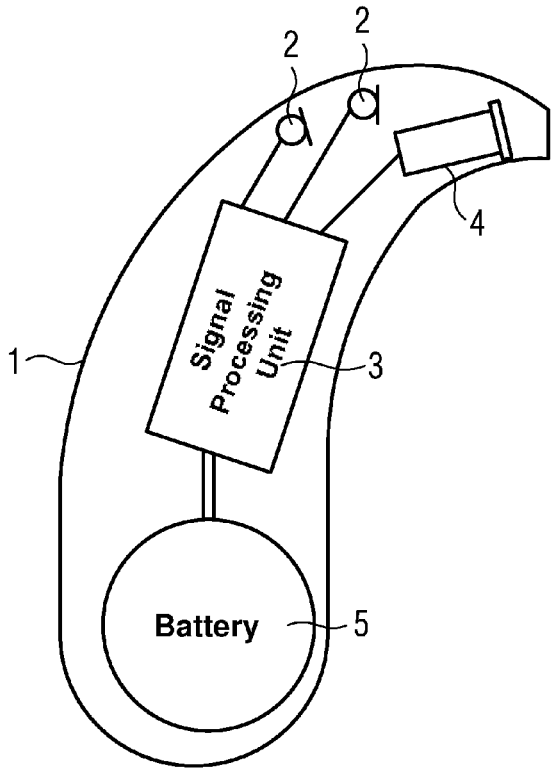
FIG. 1 PRIOR ART
FIG. 1 shows a schematic illustration of a design of a behind-the-ear hearing aid according to the prior art.
Figure 2:
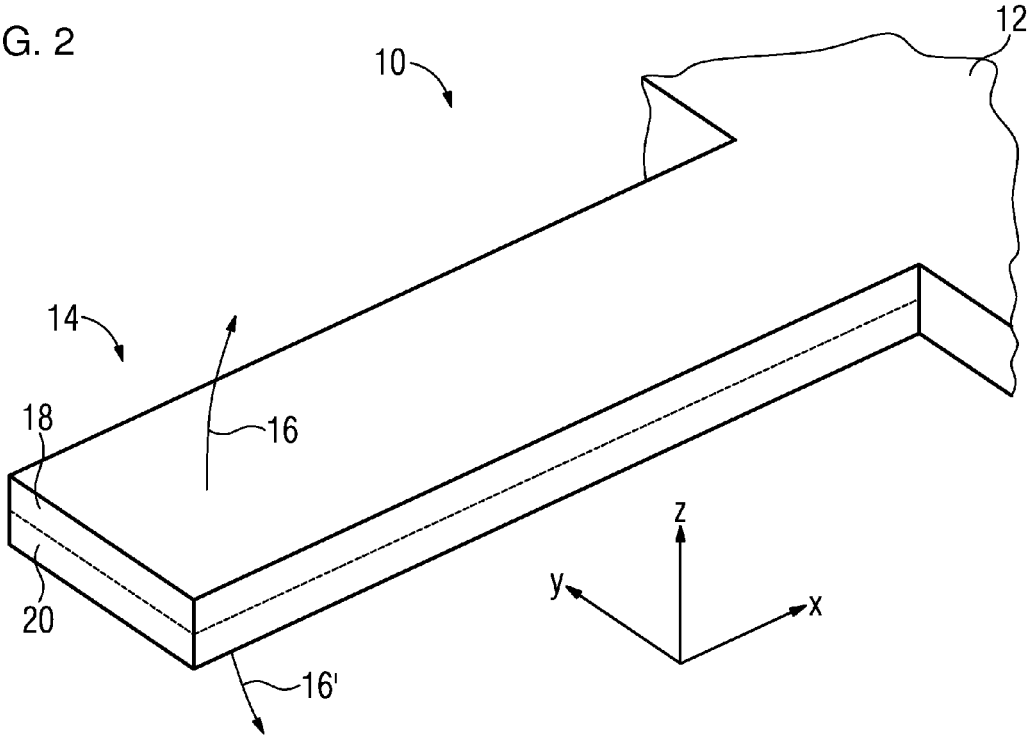
FIG. 2 shows an illustration of a basic design of an individual finger of an emission apparatus, as is part of the hearing device according to the invention.

Referring now once more to the figures of the drawing in detail FIG. 2 illustrates a finger 10 in a perspective view. The finger 10 is designed as a self-supporting structure on a microchip 12. Here, the microchip 12 is merely illustrated in part, which is indicated by curved break lines. The finger 10 has the shape of a long, flat, narrow tooth, i.e. the finger 10 has a greater dimension along an x-axis than along a y-axis, wherein the two dimensions in turn are greater than a dimension along a z-axis. The directions are indicated in FIG. 2 and in the further figures as well by coordinate axes of a Cartesian coordinate system. Here, the specified directions correspond in the individual figures.

The finger 10 can generate sound in the audible range by deflecting a freely movable end 14 of the finger 10 in the direction of the smallest extent of the finger 10, i.e. along the z-axis. Corresponding deflection directions 16, 16' are indicated by arrows in FIG. 2. In other words, the finger 10 is an actuator for generating airborne sound as a function of a field penetrating it. Of course, in order to generate a sound, the finger 10 has to oscillate to and fro in the process at a correspondingly high frequency.

The finger 10 is made of two layers 18, 20. At least one of the layers 18, is an active layer consisting of a material that can be deformed by the inverse piezoelectric effect or the magnetostrictive effect. In the example shown in FIG. 2, the assumption is made that the layer 18 is such an active layer. In order to deform the finger 10, it is only necessary to generate a corresponding field that penetrates the layer 18. By way of example, a field generation apparatus can comprise an arrangement made of two electrically conductive plates, between which an electric field can be generated. A coil can be used to generate a magnetic field.

In order to explain the example, the assumption is furthermore made that the layer 18 is made of a magnetostrictive material. If a magnetic field that penetrates the finger 10 is generated in the vicinity of the finger 10, it can cause the layer 18, for example, to expand along the x-axis. The layer 18 and the layer 20 are fixedly interconnected. Should the layer 20 not change its length in the same way as layer 18, mechanical tension is formed in the finger 10 and this bends the finger 10 and thus deflects the freely movable end 14 in the direction 16'. Rapid changes in the magnetic field can thus generate sound waves by means of the finger 10, which sound waves are mainly emitted along the z-axis by the finger 10.

The layer 20 can likewise be made of an active material. An appropriate choice of materials for layers 18 and 20 can then elongate one layer in the case of a certain magnetic field while the other layer shortens. This can firstly afford a larger deflection of the freely movable end 14 along the direction 16 or 16' for a particular magnetic field. Provision can also be made in the case of the two layers 18 and 20 for one to be deformable by means of the inverse piezoelectric effect and the other one to be deformable by means of the magnetostrictive effect.

Figure 3:
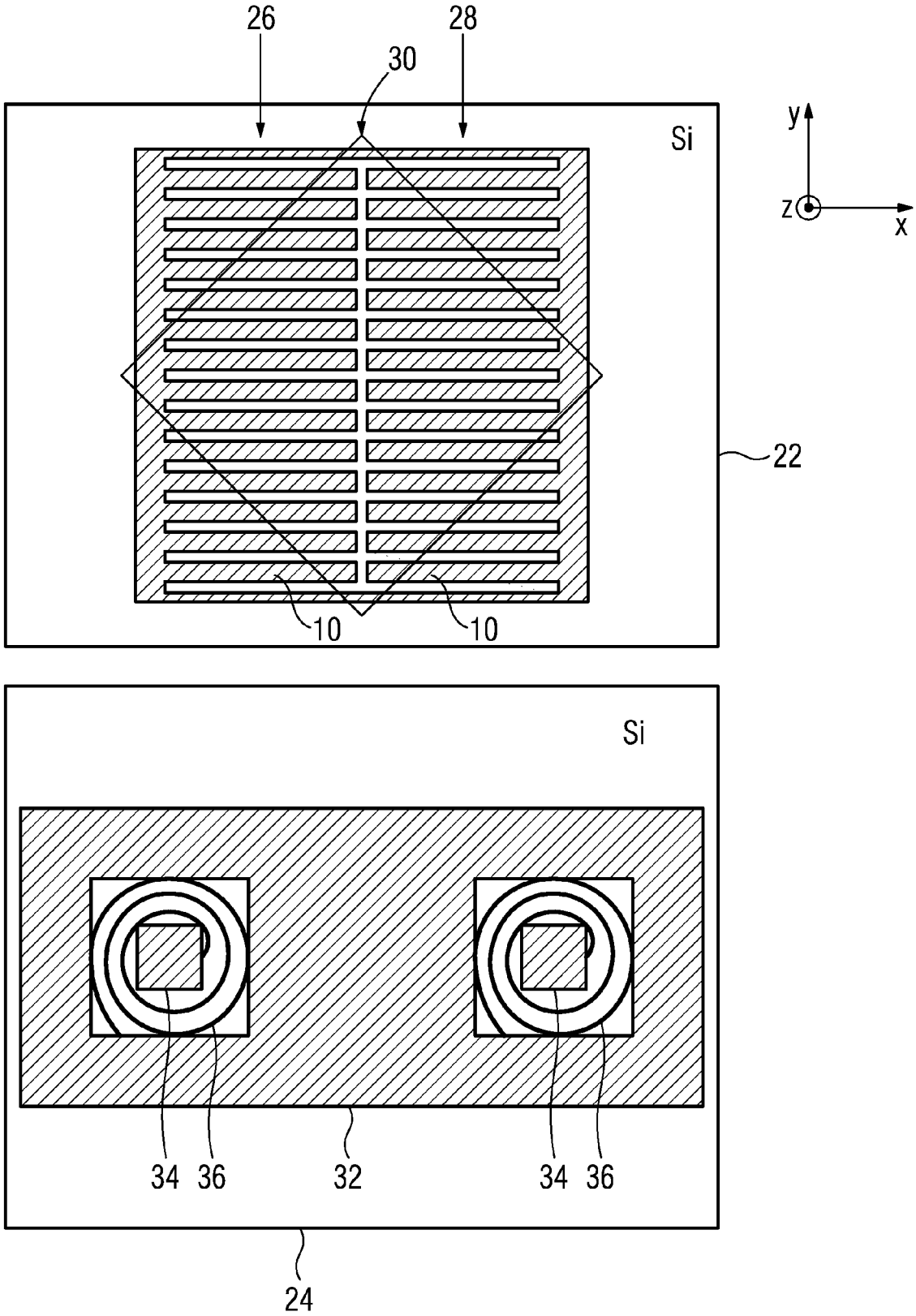
FIG. 3 shows a schematic illustration of a plan view of two microchips for a sound transducer of an embodiment of the hearing device according to the invention.

FIG. 3 shows two microchips 22, 24, which form components of a sound transducer. The two microchips 22 and 24 are micro-electromechanical systems (MEMS). The microchip 22 provides an emission apparatus; the microchip 24 provides a field generation apparatus.

A carrier substrate of the microchips 22 and 24 can be made of silicon (Si). Two rows 26, 28 of fingers 10 made of further layers are arranged parallel to one another on the carrier substrate of the microchip 22. Only two of the fingers 10 in FIG. 3 are provided with a reference sign. In principle, the fingers 10 of the microchip 22 are of the same design as the finger shown in FIG. 2. In the microchip 22, the fingers 10 are arranged in the x-y plane. In the illustrated example, they can be bent about an axis parallel to the y-axis by the magnetostrictive effect, and so free ends of the fingers 10 are deflected in the positive or negative z-direction. The carrier substrate has a hole 30 formed therein, with a profile of a wall of the carrier substrate delimiting the hole being indicated in FIG. 3.

A soft-magnetic core 32 is disposed on the carrier substrate of the microchip 24. The coil core 32 has two bases 34, around which windings of flat coils 36 run in each case. The coils 36 can via supply lines (not illustrated in FIG. 3) be coupled to a signal processing unit by means of which an electric audio signal can be generated. The electric audio signal can generate an alternating magnetic field by means of the coils 36. Provision can also be made for cylindrical coils instead of the flat coils 36. It is also possible for provision to be made for a plurality of flat coils stacked on one another with more than one layer of windings and layers of insulations between the windings.

The soft-magnetic core 32 can be made of a nickel-iron alloy (NiFe). The soft-magnetic core 32 and the coils 36 can be produced by a vapor deposition process and/or electroplating or plating.

Figure 4:
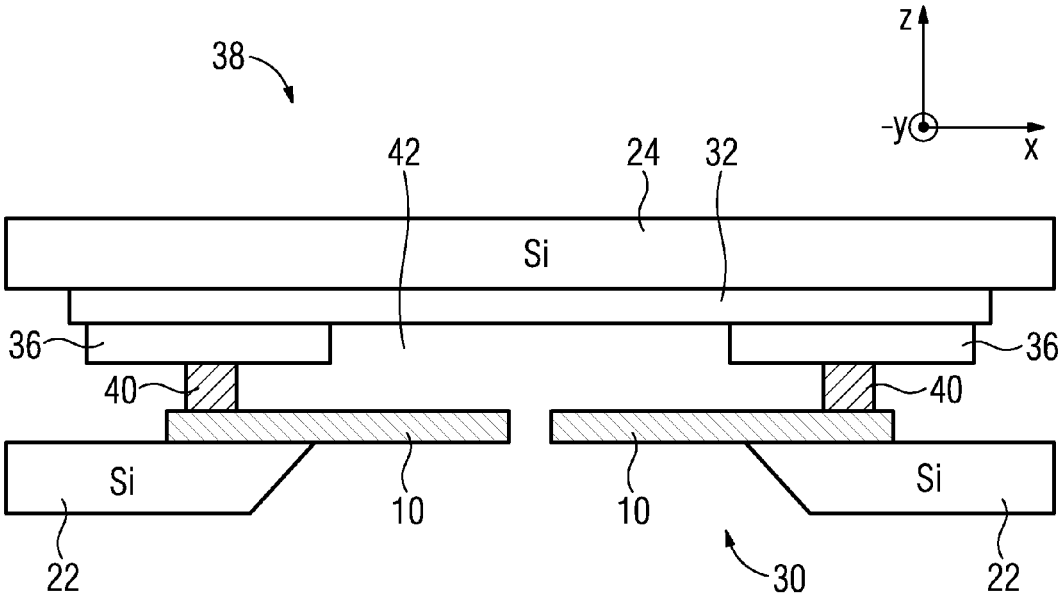
FIG. 4 shows a schematic illustration of a side view of a sound transducer with two microchips, wherein the sound transducer is part of an embodiment of the hearing device according to the invention.

FIG. 4 shows a sound transducer 38 made of the two microchips 22 and 24 shown in FIG. 3. FIG. 4 shows a cross section of the sound transducer 38. There are two permanent magnets 40 between the two microchips 22 and 24. The microchips 22 and 24 and the permanent magnets 40 can be interconnected by means of an adhesive.

The permanent magnets 40 generate a permanent magnetic field. This permanent magnetic field forms a magnetic field offset that also penetrates the fingers 10 in a rest position when no current flows through the coils 36. This magnetic field offset sets an operating point for the sound transducer 38. This is explained in more detail in conjunction with FIG. 6.

Furthermore, the fingers 10 are bent by the permanent magnetic field of the permanent magnets 40 such that they have a desired shape in the rest position. Supplying the coils 36 with current, as is possible by the signal processing unit, generates an additional magnetic field that is guided by the core 32 and deflected onto the fingers 10. The fingers 10 then change their shape as a function of the magnetic field. More particularly, the free ends of the fingers 10 are deflected along the z-axis. If an alternating magnetic field is generated by the coils 36, the field strength of which changes in accordance with an audio signal, this results in a corresponding forced oscillation in the fingers 10. The oscillations of the fingers 10 then generate sound waves. In the process, an interspace between the microchip 22 and the microchip 24 forms a resonant cavity 42. The generated sound is emitted downward in FIG. 4, through the hole 30 in the carrier substrate of the microchip 22.

The permanent magnets 40 can be provided as independent components. They can also be made by generating highly permeable hard-magnetic layers on one of the two microchips 22, 24 by means of MEMS technology, wherein the layers are magnetized during the production of the microchip such that they act as permanent magnets.

FIG. 5 shows how fingers can be arranged for generating sound in an emission direction. For this, FIG. 5 is subdivided into six partial FIGS. 5A to 5F. The individual partial figures each show an arrangement (a) to (F) of fingers, i.e. FIG. 5A shows arrangement (a) etc. In the following text, reference is not made to the individual partial figures, but directly to the arrangements (a) to (f) shown therein. Here, the illustration of the fingers corresponds to that illustration as can be seen in the case of the microchip 22 in FIG. 3. The length of each finger, i.e. its dimension along the x-axis, lies between 0.5 and 5 mm in the examples shown in FIG. 5. There is a gap 44 between respectively two figures. Each of the long, narrow figures for generating sound has a mechanical natural frequency at which it oscillates to and fro once it has been deflected and external forces no longer act thereon.

In arrangements (b), (c), (d) and (f), two fingers are in each case arranged offset with respect to one another or fingers of different lengths are arranged next to one another, and therefore the gaps 44 running between the individual fingers are shorter than in arrangement (a). This increases an acoustic resistance of the arrangements.

In arrangements (c) to (f), provision is made for fingers of different lengths. The fingers of different lengths also have different natural frequencies. An appropriate selection of the lengths of the individual fingers in arrangements (c) to (f) adjusts a frequency characteristic of the respective arrangement such that a micro-loudspeaker with a certain transmission property can be provided by these arrangements. Here, a desired frequency characteristic is brought about for a certain audio band in a targeted fashion.

In arrangement (e), two fingers of equal length are arranged opposite one another in each case. In other words, the respective longitudinal axes of two fingers of equal length are parallel to one another and the fingers are arranged successively in the direction of their longitudinal extent. Here, the fingers point at one another with their freely movable ends.

If, in this case, two opposing fingers are bent by means of a magnetic field in order to deflect their freely movable ends in a direction along the z-axis, the deflection at the two ends is of approximately the same size. Then, the width of a central gap 46, i.e. its dimension along the x-axis, is not significantly enlarged in this case. This prevents excessive amounts of air flowing past the fingers through the central gap 46 (acoustic short circuit) when producing sound waves. Such an arrangement therefore has particularly high effectiveness when generating sound.

The fingers can be covered by a film or a membrane and so the entire arrangement of the fingers is covered by a closed layer. The membrane then closes off the gaps 44 and so air can no longer flow past the fingers.

Figure 6:
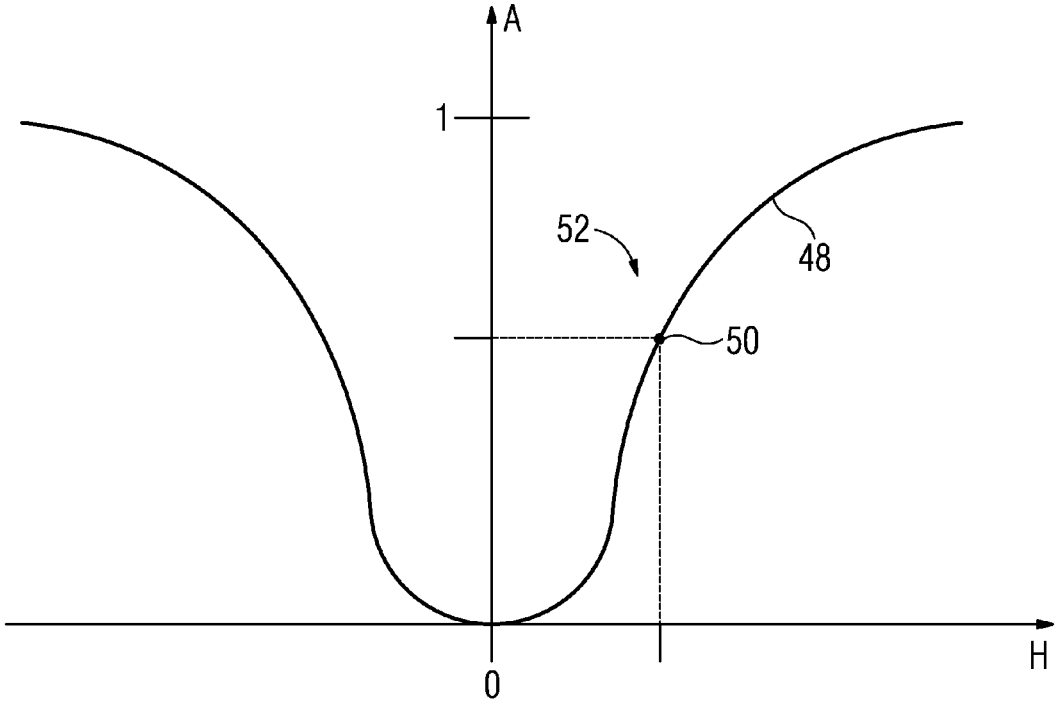
FIG. 6 shows a diagram showing a dependence of a deflection of a finger on a magnetic field in the case of an emission apparatus of an embodiment of the hearing device according to the invention.
Figure 5A:
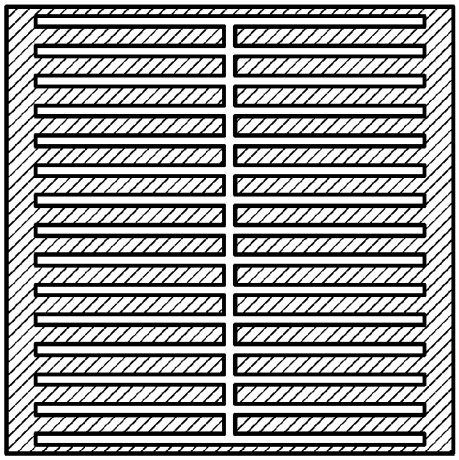
FIG. 5 shows schematic illustrations of emission apparatuses, as are possible in different embodiments of the hearing device according to the invention.
Figure 5B:
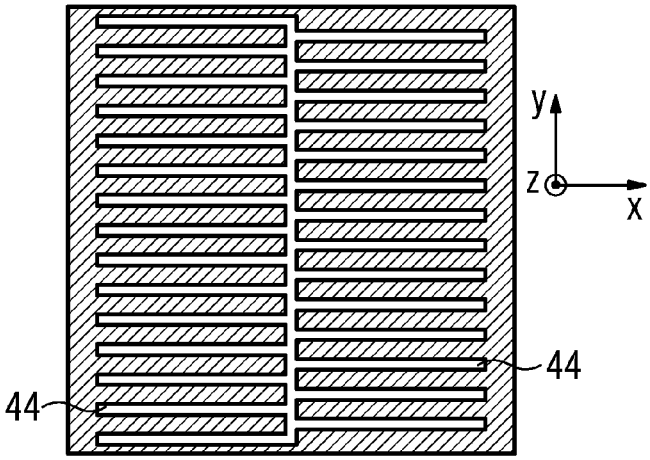
Figure 5C:
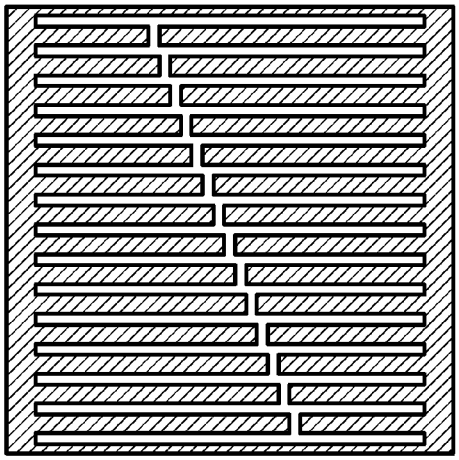
Figure 5D:
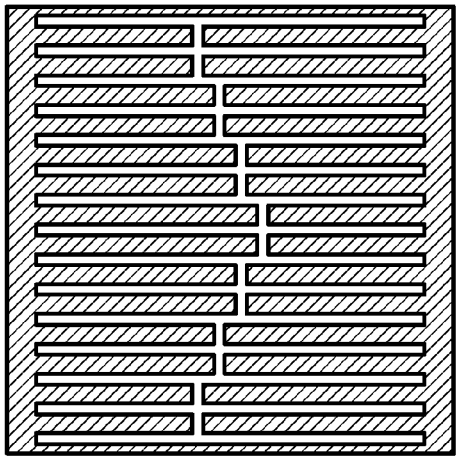
Figure 5E:
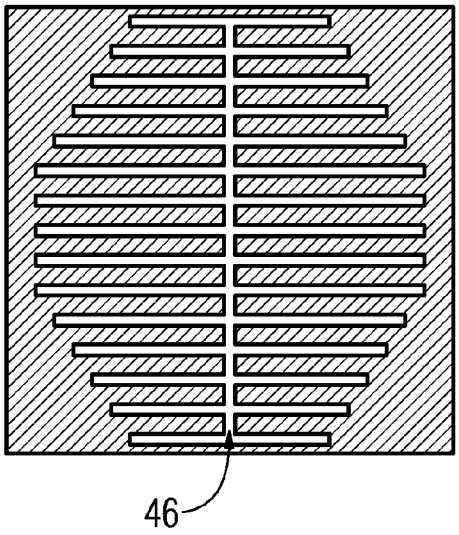
Figure 5F:
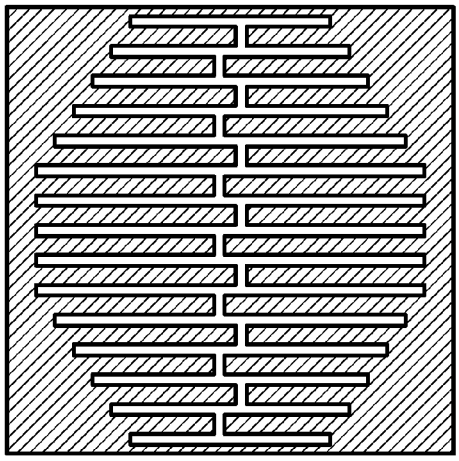

FIG. 6 shows a graph 48 illustrating a dependence of a deflection A of a finger on a field strength H of a magnetic field penetrating the finger. The finger is part of an emission apparatus of a sound transducer. The field can be generated by an appropriate field generation apparatus of the sound transducer.

By way of example, the deflection A can be determined as the magnitude of a distance between two positions that a particular point on the finger assumes in space when the field has, firstly, a field strength of zero and, secondly, a certain field strength H. The deflection A has been normalized in this case such that the largest possible deflection results in a value of 1. The magnetostrictive effect is nonlinear and exhibits in some areas an almost quadratic dependence of the deflection A on the magnetic field strength H. However, a dependence which is as linear as possible is desirable, at least for small changes in H.

This is why a magnetic field offset is generated by the permanent magnets 40 in the example illustrated in FIG. 4. Said field deflects the fingers such that an almost linear relationship results for a further deflection as a function of a magnetic field generated by means of the coils 36. FIG. 6 shows such a possible operating point 50, at which the graph 48 exhibits an almost linear profile 52.

Figure 7A:
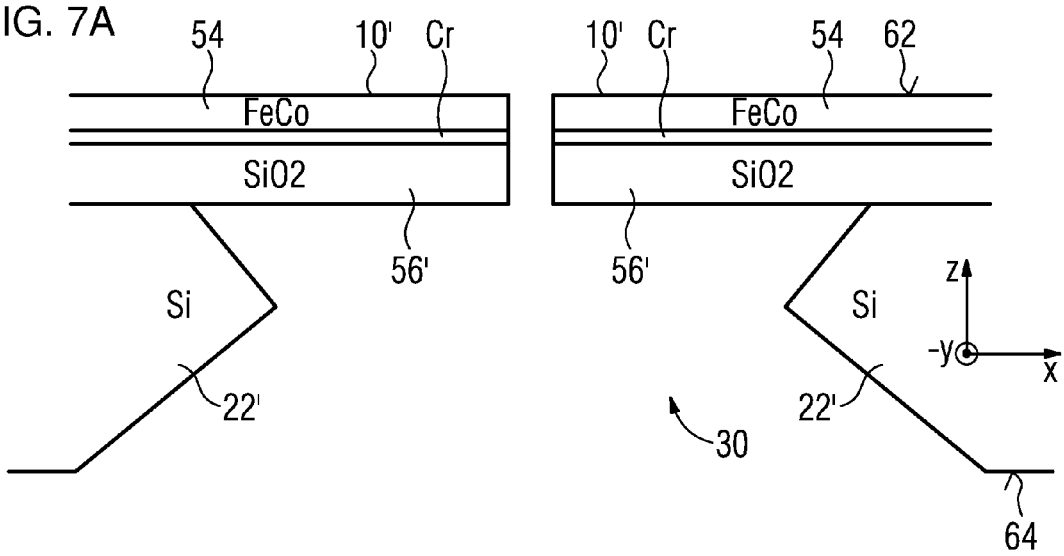
FIG. 7 shows schematic illustrations of cross sections of emission apparatuses, wherein the emission apparatuses are parts of different embodiments of the hearing device according to the invention.
Figure 7B:
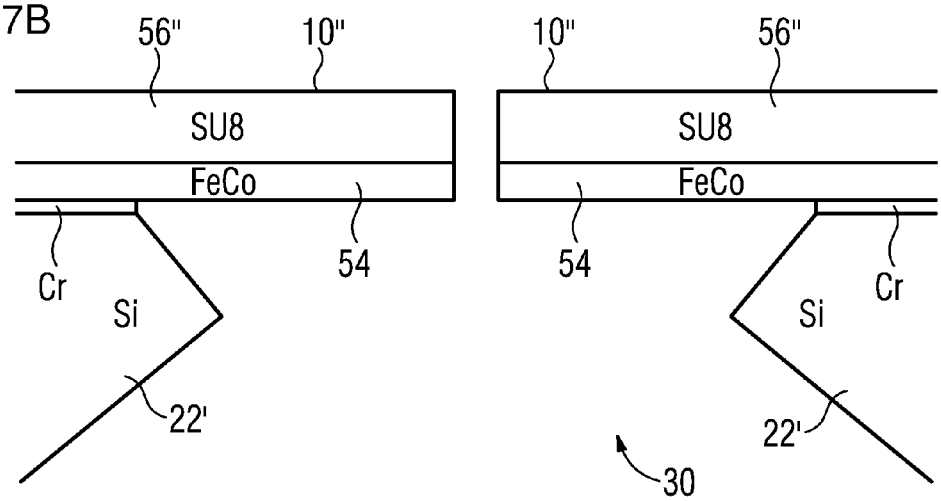
Figure 7C:
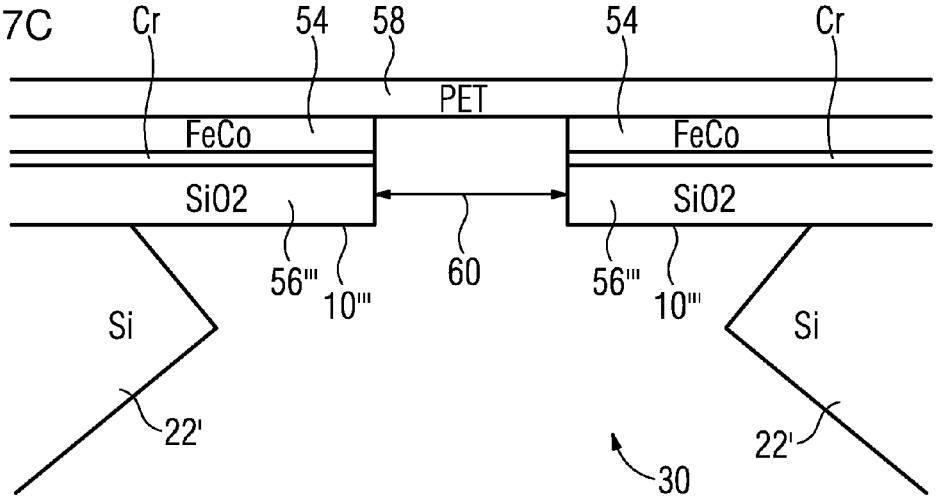

FIG. 7 shows a composition of examples (a) to (c), of how fingers 10', 10", 10'" can be made of different layers. Similarly to FIG. 5, FIG. 7 is in this case subdivided into partial FIGS. 7A to 7C, wherein FIG. 7A shows example (a) etc. In the following text, reference is once again made directly to the respective example and not to the figure showing the example.

The fingers 10', 10", 10'" are actuators that can be deformed by means of the magnetostrictive effect. For this, the fingers 10', 10", 10'" each have an active layer 54 made of an alloy of iron and cobalt (FeCo). A carrier substrate 22' is made of silicon (Si) in all examples. In addition to the active layers 54, the fingers 10', 10", 10'" each have a passive layer 56', 56", 56'".

In example (a), the passive layer 56' of the fingers 10' is made of silicon dioxide ($SiO_2$). The passive layer 56' is situated between the carrier substrate 22' and the active layer 54. Between the active layer 54 and the passive layer 56' there is a relatively thin layer of chromium (Cr) that improves adherence of the active layer 54 on the passive layer 56'. A magnetic field affords the possibility of elongating the active layers 54 along the x-axis. Then the fingers 10' in FIG. 7 bend downward, i.e. in the negative z-direction.

In example (b), the carrier substrate 22' and the active layer 54 are interconnected by a thin layer of chromium on each finger 10". On each active layer 54 there is a passive layer 56" made of SU-8, an epoxy resin that can be applied to the active layer 54 by means of MEMS technology. If a magnetic field causes a elongation of the active layers 54 along the x-axis, the fingers 10" bend upward in the z-direction in example (b).

The material SU-8 has advantageous properties in respect of insulation and mechanical and chemical properties. A layer of SU-8 as a passive layer has the additional advantage that the material is more flexible than silicon dioxide. It can also be applied to the active layer 54 in a simple fashion by spinning.

In example (c), the fingers 10'" have the same design as in example (a). The fingers 10'" are additionally covered by a film or a membrane 58. By way of example, the membrane 58 can be made of polyethylene terephthalate (PET). A further difference between examples (a) and (c) consists of the fact that in example (c) the fingers 10'" have a larger separation 60 from one another. However, the membrane 58 nevertheless prevents an acoustic short circuit in this case when generating sound waves.

FIG. 7 also shows how the fingers 10', 10", 10'" project over a hole 30 in the carrier substrate 22'. Over the hole 30, the freely movable ends of the fingers 10', 10", 10'" can oscillate freely along the z-axis.

The hole 30 can be produced in the carrier substrate 22' by means of an anisotropic etching or pickling method. Irrespective of whether an acid, a lye or a different chemical solution is used as a medium for dissolving in this process, this is referred to as etching. An example of such a process is two-stage anisotropic etching using potassium hydroxide (KOH).

At this point, the production process should be explained in more detail using example (a) from FIG. 7. The carrier substrate 22' can for example be provided by a silicon wafer. The preferred orientation is <100> for the carrier substrate 22'. The lithography masks for the fingers are preferably oriented by 45° with respect to the crystal axes. In order to generate the hole, the entire substrate, consisting of the layers 22', 56', the chromium layer and the layer 54 on a front side 62, i.e. on the side of the layer 54, is covered and the etching medium is applied to a rear side 64, i.e. to the side of the carrier substrate 22'. The etching medium then dissolves the carrier substrate, generating the hole 30. Before there is a breakthrough, the cover on the front side is removed and the etching medium is also applied to the front side 62. In regions of cutouts in the lithography mask, this then results in a breakthrough in the substrate and so the self-supporting structures of the fingers 10' are created. Arranging the fingers in respect of the crystal axes and etching in the described manner allow the desired structures to be produced in a particularly simple and precise fashion. In particular, this affords the possibility of reliably removing the carrier substrate 22' from a region directly adjoining the layer 56' by means of the etching process. This ensures that the fingers 10' can oscillate freely.

The examples have shown how sound waves can be generated with the aid of long, narrow fingers produced by microsystem technology. Arranging the fingers close together allows an arrangement of a multiplicity of fingers to produce sound waves in the audio-frequency range in a similar fashion to a closed membrane. Using long and narrow fingers as actuators achieves particularly large deflections of the actuators by means of the piezoelectric or magnetostrictive effect. A further advantage resulting from the provision of individual fingers is that each finger has its own mechanical natural frequency depending on its length. Therefore, the provision of fingers of different lengths affords the possibility of producing a micro-loudspeaker in which a frequency characteristic can be adjusted as desired by setting the individual lengths of the fingers. This cannot be achieved as easily as this in the case of a loudspeaker with a single membrane.

The invention claimed is:

1. A hearing device, comprising:

a sound transducer having:

a field generation apparatus for generating an electric or magnetic field; and an emission apparatus for generating sound, said emission apparatus having a multiplicity of fingers disposed to be penetrated by the field of said field generation apparatus, said fingers having a shape to be changed by way of the field of said field generation apparatus in order to generate the sound.

2. The hearing device according to claim 1, wherein at least one of said fingers comprises at least two mutually parallel layers, and at least one of said layers is deformable by an effect selected from the group consisting of an inverse piezoelectric effect or a magnetostrictive effect.

3. The hearing device according to claim 2, wherein at least one of said fingers comprises two layers that are each deformable by one of the effects.

4. The hearing device according to claim 1, wherein said emission apparatus includes a layer formed with a hole, and said fingers are disposed above said hole.

5. The hearing device according to claim 1, wherein said emission apparatus includes a membrane covering said fingers.

6. The hearing device according to claim 5, wherein said membrane is made of polyethylene terephthalate.

7. The hearing device according to claim 1, wherein said fingers are disposed in two mutually parallel rows of fingers.

8. The hearing device according to claim 7, wherein said fingers in a respective said row are of equal length.

9. The hearing device according to claim 1, wherein said fingers include fingers of mutually different lengths.

10. The hearing device according to claim 1, wherein said fingers include fingers disposed at an offset to one another.

11. The hearing device according to claim 1, wherein two fingers of equal length are in each case arranged opposite to one another.

12. The hearing device according to claim 1, wherein said field generation apparatus comprises a permanent magnet.

13. The hearing device according to claim 1, wherein said field generation apparatus includes a flat coil.

14. The hearing device according to claim 1, wherein said field generation apparatus is formed, at least in part, as a first microchip, and said emission apparatus is formed as a second microchip.

15. A method for producing a sound transducer with a multiplicity of fingers for generating sound, the method which comprises:

providing a substrate;

arranging a protective layer on a front side of the substrate, wherein a shape of the fingers is determined by a profile of an edge of the protective layer; and applying a medium for dissolving the substrate to the front side and a rear side of the substrate.

16. The method according to claim 15, wherein:

the providing step comprises providing a carrier substrate with layers arranged thereon for forming the fingers; and the carrier substrate consists of silicon with the crystal orientation <100>; and the protective layer is formed such that a longitudinal axis of the respective fingers is arranged at an angle of 45° to the crystal axes of the carrier substrate.

* * * * *